US005320176A

United States Patent [19]

Naquin et al.

[11] Patent Number: 5,320,176

[45] Date of Patent: Jun. 14, 1994

[54] WELL FLUID LOSS PLUG ASSEMBLY AND METHOD

[75] Inventors: Michael J. Naquin, Kingwood; Phillip W. Schmuck, Houston, both of Tex.

[73] Assignee: Baker Hughes Incorporated, Houston, Tex.

[21] Appl. No.: 879,194

[22] Filed: May 6, 1992

[51] Int. Cl.[5] ..... E21B 33/12; E21B 23/02

[52] U.S. Cl. ..... 166/386; 166/181; 166/192; 166/237

[58] Field of Search ..... 166/332, 181, 182, 192, 166/237, 238, 386

[56] References Cited

U.S. PATENT DOCUMENTS 3,011,549 12/1961 Fredd et al. ..... 166/387 X
3,856,081 12/1974 Canalizo ..... 166/217 X
4,437,522 3/1984 Krause et al. ..... 166/217 X
4,576,236 3/1986 Stout et al. ..... 166/192 X
4,984,631 1/1991 Reesing ..... 166/192 X

*Primary Examiner*—David J. Bagnell
*Attorney, Agent, or Firm*—Felsman, Bradley, Gunter and Dillon

[57] ABSTRACT

A well servicing assembly utilizes a plug mechanism for preventing fluid loss into a formation. The assembly includes a string of tubing which carries a packer, a perforating gun, a running tool, and a latch assembly. After perforating, the operator pulls the tubing upward, leaving the packer in place. The latch assembly engages the packer. The latch assembly has a plug contained therein which prevents downward flow of fluid through the packer as the tubing string is retrieved to the surface. After removing the perforating gun, the tubing string may be again lowered and re-engaged with the latch assembly. The latch assembly may be then repositioned below the packer.

20 Claims, 4 Drawing Sheets

WELL FLUID LOSS PLUG ASSEMBLY AND METHOD

BACKGROUND OF THE INVENTION

1. Field of the Invention

This invention relates in general to oil well completion equipment, and in particular to an apparatus for preventing loss of fluid in the casing into the formation after perforating.

2. Description of the Prior Art

In one type of well completion, a perforating gun will be secured to a string of tubing and lowered into the casing. A packer will be supported by the string of tubing above the perforating gun. When at the proper depth, the operator will set the packer in the casing. The operator then fires the gun either by increasing hydraulic pressure in the gun from the surface or by dropping a firing bar.

The shaped charges in the perforating gun will penetrate through the casing and annular layer of cement surrounding the casing. The well typically will then be flowed through the tubing for a test. After the test, the perforating gun is retrieved. Once the gun is pulled up through the bore of the packer, fluid contained in the casing above the packer is free to flow down through the bore in the packer.

In some formations, because of low pressure, a considerable amount of the fluid in the casing will flow through the packer into the formation. The penetration of a large amount of well completion fluid into the formation may make it difficult to cause the well to flow formation fluid again.

SUMMARY OF THE INVENTION

In this invention, a seat profile is mounted to the lower end of the packer. A latch assembly is carried on a string of tubing below the perforating gun when the perforating gun and the packer are lowered into the well. A plug is carried in the latch assembly.

After perforating, the operator picks up the tubing. The latch assembly will latch and seal into the seat profile. Continued upward movement will release the lower end of the tubing from the latch. Fluid located above the packer is prevented from flowing downward by the plug.

The operator retrieves the perforating gun. He then removes the perforating gun from the tubing and re-enters the well with the tubing. If re-entering with a production string, the latch assembly will remain seated in the seat profile. Once the production string has reconnected to the packer, the operator will lower a wireline retrieval tool through the tubing to equalize pressure across the plug and retrieve the plug. Production will flow through the bore of the latch assembly.

Alternately, the operator may wish to re-enter with a gravel pack tool to pack gravel into the perforations. In event of a gravel pack operation, a running tool on the lower end of the tubing will re-engage the latch assembly. Continued downward movement causes the latch assembly to release from the seating profile and move to a position spaced below the packer.

DETAILED DESCRIPTION OF THE INVENTION

Figure 1:
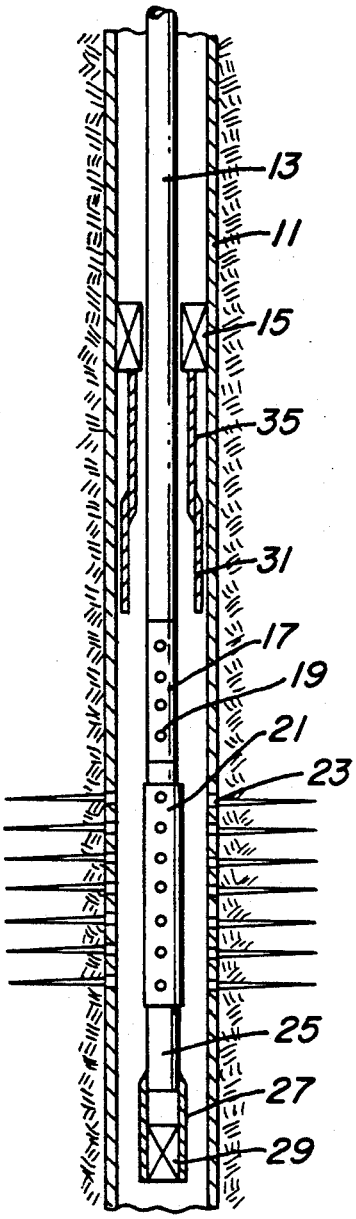
FIG. 1 is a schematic sectional view illustrating a well and an apparatus constructed in accordance with this invention, and shown immediately after perforating the casing.

Referring to FIG. 1, the well will have casing 11 cemented in place. A string of tubing 13 is shown lowered into casing 11. A packer 15 will be lowered with the string of tubing 13. A circulation sub 17 will be located in the string of tubing 13 below packer 15. Circulation sub 17 has circulation ports 19 to allow circulation of fluid down the tubing 13 and up through an annular space between tubing 13 and the bore in packer 15.

A perforating gun 21, which may be made up of a large number of separate guns, will be mounted in the string of tubing 13 below circulation sub 17. Perforating gun 21 is conventional, having a large number of shaped charges (not shown), which when ignited will pierce casing 11 and the surrounding formation to create perforations 23.

In this invention, a running tool 25 will be secured below perforating gun 21 into the string of tubing 13. A latch assembly 27 releasably secures to running tool 25. A plug 29 conventional design will locate within latch assembly 27. A seat profile 31 will be mounted to packer 15 and spaced below.

Figure 4A:
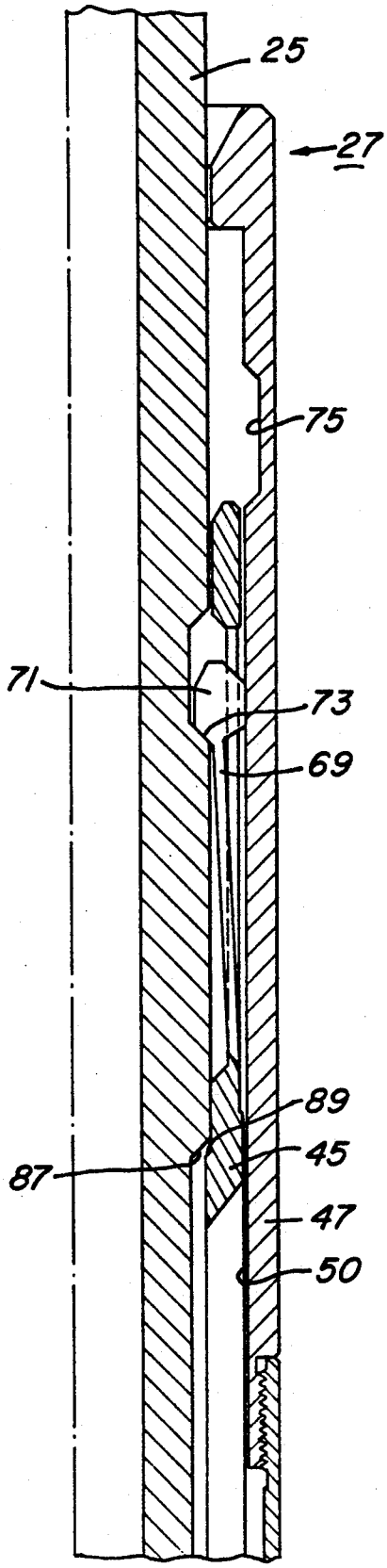
FIGS. 4*a, b* and *c* make up a vertical sectional view of portion of the apparatus of FIG. 1, and shown prior to the latch assembly entering a seat profile.
Figure 4B:
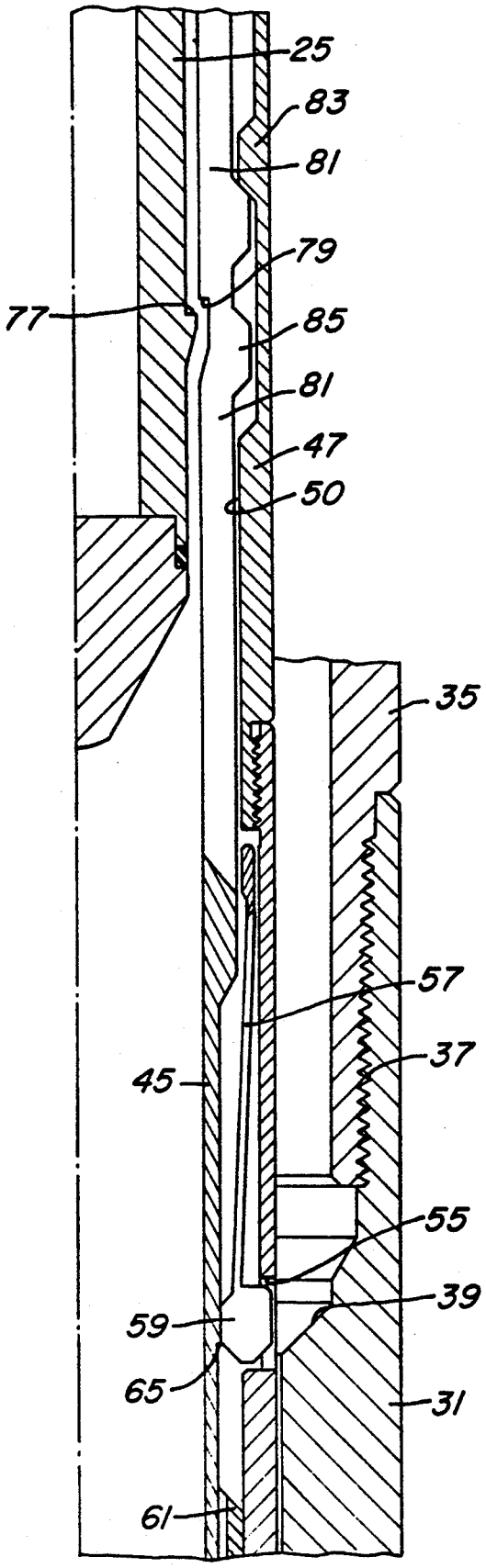
Figure 4C:
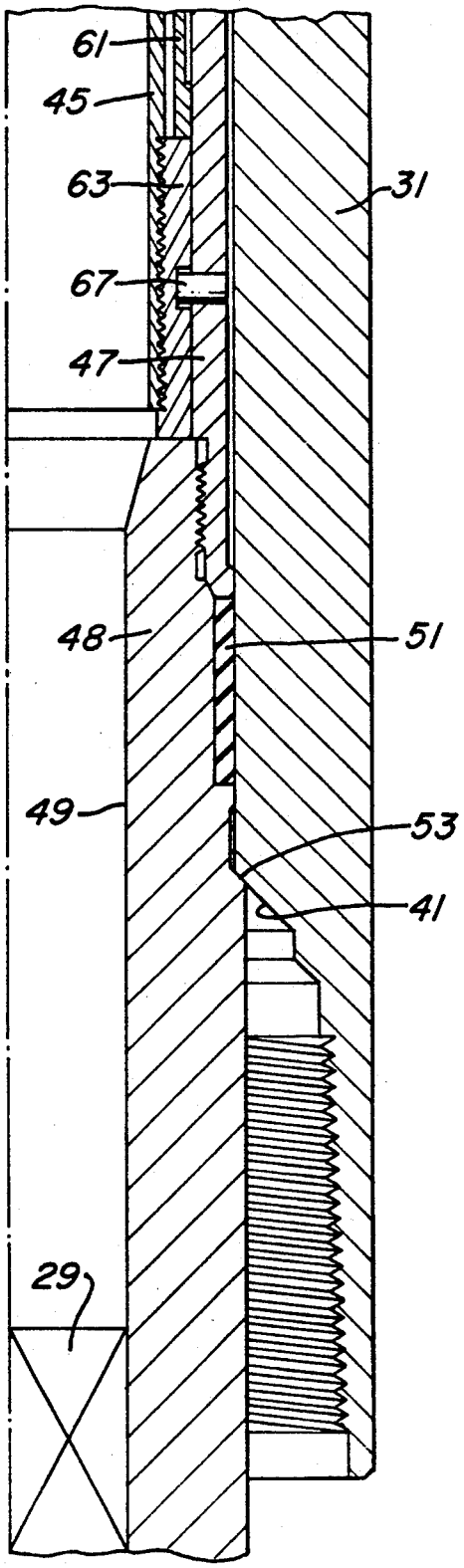

More details of the latch assembly 27 are illustrated in FIGS. 4*a, b, c* and 5*a, b, c*. Referring to FIG. 4*b*, an extension sub 35 will have an upper end that secures to the packer 15 (FIG. 1) and a lower end which supports the seat profile 31. Seat profile 31 is a tubular sub that connects to the extension sub 35 by threads 37. Seat profile 31 has an interior upward facing shoulder 39. As shown in FIG. 4*c*, seat profile 31 also has an interior downward facing shoulder 41.

As shown in FIGS. 4*a* and 4*b*, latch assembly 27 includes a tubular mandrel 45 that is slidably carried within a tubular housing 47, which has a bore 50. Housing 47 includes a lower housing section 48 which has a bore 49, shown in FIG. 4*c*, for receiving a conventional plug 29. Plug 29 may be a permanent type, secured by threads to a lower end of housing 47. Alternately, if gravel pack tool 33 (FIG. 3) is not to be used, plug 29 will be a conventional retrievable type. Although the bore 49 is shown to be cylindrical, recesses and shoulders will be formed at various points to receive a retrievable plug 29. A retrievable plug 29 will have latches, a means to be engaged by a running tool run on a wire line (not shown), and means for equalizing pressure prior to retrieving the plug 29.

An elastomeric seal 51 locates on the exterior of the lower section 48 of housing 47, as shown in FIG. 4c. Seal 51 will seal in the bore of seat profile 31 when the latch assembly 27 is pulled up into the seat profile 41.

Referring still to FIG. 4c, the lower section 48 of housing 47 has an external upward facing shoulder 53 below seal 51. Shoulder 53 is positioned to engage seat profile shoulder 31. The outer diameter of shoulder 53 is greater than the inner diameter of shoulder 41. This prevents shoulder 53 from moving upward past shoulder 41.

Referring to FIGS. 4b and 4c, housing 47 has a plurality of circumferentially spaced apertures 55. Apertures 55 are positioned a slightly greater distance from shoulder 53 than the distance from seat profile shoulder 41 to seat profile shoulder 39. Consequently, when housing shoulder 53 contacts seat profile shoulder 41, apertures 55 will be spaced adjacent to the seat profile shoulder 39.

A seat engaging member or collet 57 is carried in housing 47. Seat engaging collet 57 is a splined, spring member which has lower ends or dogs 59 that will extend through the apertures 55. Dogs 59 will engage the conical shoulder 39 to support housing 47 and prevent it from moving downward. The seat engaging collet 57 is biased inward to the released position shown in FIG. 4b. Seat engaging collet dogs 59 can be forced outward through apertures 55 to the engaged position with shoulder 39, as shown in FIG. 5b.

The collet dogs 59 are pushed outward by an actuating sleeve 61. Actuating sleeve 61 is slidably carried on the exterior of mandrel 45. A stop ring 63 is located a short distance below actuating sleeve 61. When stop ring 63 contacts the lower end of actuating sleeve 61, during upward movement of mandrel 45 relative to housing 47, the actuating sleeve 61 will push the collet dogs 59 outward to the engaged position shown in FIG. 5b.

During the releasing of latch assembly 27 from seat profile 31, mandrel 45 moves downward relative to housing 47. A shoulder 65 on the exterior of mandrel 45 will contact the upper end of actuating sleeve 61. Continued downward movement will push actuating sleeve 61 downward, allowing the collet dogs 59 to spring back inward to the released position shown in FIG. 4b. Mandrel 45 will thus move a short distance vertically relating to actuating sleeve 61, but then will either move actuating sleeve 61 upward or downward in unison with the movement of mandrel 45.

Referring to FIG. 4c, initially, mandrel 45 will be locked to housing 47 by a retaining means so that it will not be able to move vertically relative to housing 47. This is handled by a plurality of shear screws 67 (only one shown) which extend from the stop ring 63 into the sidewall of housing 47. When housing shoulder 53 contacts seat profile shoulder 41, continued upward force on the string of tubing 13 will transmit from the running tool 25 (FIG. 4a) through the mandrel 45. Once the force is sufficient, the shear screws 67 will shear. This allows mandrel 45 to move upward relative to housing 47. Shear pin 67 thus serves as a retaining means for retaining mandrel 45 in the lower position shown in FIG. 4a, b and c.

Running tool 25 is releasably secured to mandrel 45 as shown in FIG. 4a. The means to secure mandrel 45 to running tool 25 includes a running tool collet 69. Running tool collet 69 is a spring member integrally formed on the upper end of mandrel 45. Running tool collet 69 has a plurality of parallel, vertical slots, creating fingers. Running tool collet 69 has an upper end 71 that will move between an inward engaged position shown in FIG. 4a to an outer released position shown in FIG. 5a. In the engaged position, running tool collet ends or dogs 71 locate in a recess defined by a running tool shoulder 73. The bias of running tool collet 69 is radially outward. Upward force on running tool 25 transmits from shoulder 73 to the collet dogs 71 and from there to the remaining portions of mandrel 45.

Figure 5A:
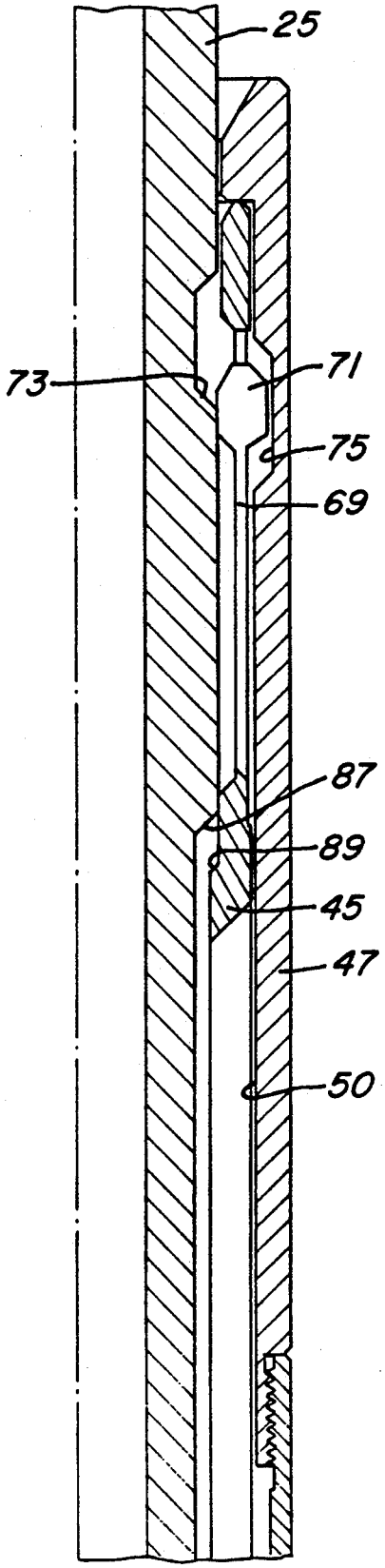
FIGS. 5*a*, 5*b* and 5*c* make up a vertical sectional view of the apparatus of FIGS. 4*a, b, c,* but showing the apparatus in a latched position in the seat profile, and the running tool being removed from the latch assembly.
Figure 5B:
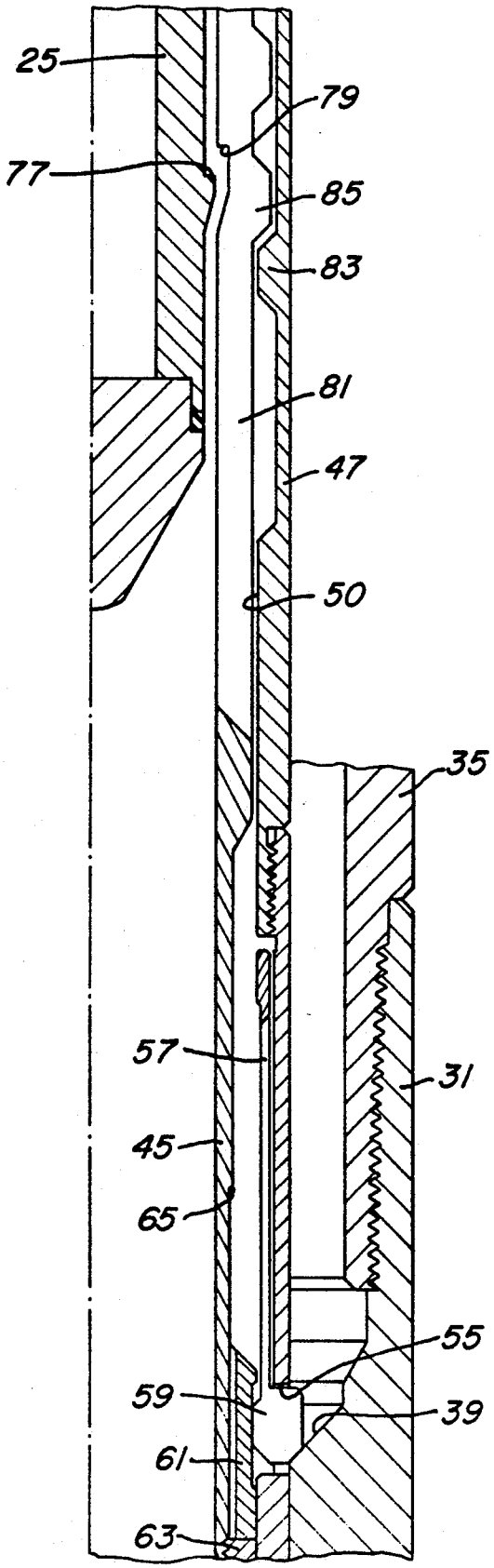

When in the released position shown in FIG. 5a, collet dogs 71 will locate within an internal recess 75 formed near the upper end of housing 47. The outward bias of collet dogs 71 causes them to spring into recess 75 and remain there as shown in FIG. 5a unless mandrel 45 is moved downward. The smaller portion of housing bore 50 immediately below recess 75 pushes the collet dogs 71 over to the inner engaged position when the mandrel collets 71 are located below recess 75.

The dimensions of running tool 25, mandrel 45 and housing 47 are selected so that the seat engaging collet dogs 59 will be expanded outward and protruding through apertures 55 in the engaging position with shoulder 39 before the collet dogs 71 engage recess 75. This assures that the housing 47 will be suspended on the seat profile 31 before the running tool 25 releases the mandrel 45.

A safety shoulder 77 is provided on running tool 25, as shown in FIG. 4b. Safety shoulder 77 is upward facing and located near the lower end of running tool 25. A mating safety shoulder 79 locates in the interior of mandrel 45. Safety shoulder 77 will be below safety shoulder 79 until collet dogs 71 engage housing recess 75. So as to allow running tool 25 to be pulled out of mandrel 45, the outer diameter of running tool safety shoulder 77 is less than the inner diameter of mandrel safety shoulder 79 when safety shoulder 79 is in a relaxed position. This allows safety shoulder 77 to move past safety shoulder 79 when running tool 25 is being released.

Mandrel safety shoulder 79 is located in a deflecting section 81 of mandrel 45, which moves safety shoulder 79 radially inward from the relaxed position shown. Deflecting section 81 has vertical fingers and is capable of radial spring deflection from a relaxed outer position shown in FIG. 4b to an inner position (not shown). In the inner position, the inner diameter of safety shoulder 79 will be less than the outer diameter of safety shoulder 77.

The deflection of deflecting section 81 is accomplished by a housing deflecting shoulder 83 that extends radially inward. A pair of mandrel deflecting shoulders 85 locate on the exterior of mandrel 45 for engaging shoulders 83. When mandrel 45 is moved from the lower position shown in FIG. 4b, to the upper position shown in FIG. 4c, both of the mandrel shoulders 85 must move past the housing shoulder 83.

The outer diameters of the mandrel shoulders 85 are in the natural condition greater than the inner diameters of the housing deflecting shoulder 83. This causes the deflecting section 81 to deflect radially inward during the transition between the lower position of mandrel 45 to the upper position of mandrel 45. During this transition period the shoulders 77, 79 will be positioned to engage each other. During upward movement of mandrel 45, the shoulders 77, 79 will cause the running tool 25 to continue to pull mandrel 45 a short distance upward after collet dogs 71 enter recess 75. The shoulders 77, 79 release from each other as soon as the lower mandrel shoulder 85 clears the housing shoulder 83. Shoulders 83, 85 prevent mandrel 45 from accidentally releasing from housing 47 during firing of perforating gun 21 (FIG. 1) and during transitional movement of mandrel 45 between the upper and lower positions.

For re-engagement, running tool 25 has a re-engaging shoulder 87. Shoulder 87 is downward facing, located on the exterior, and positioned to engage an upward facing shoulder 89. Shoulder 89 is located in the interior of mandrel 45. Shoulders 87, 89 are positioned so as to locate collet dogs 71 in the recess above shoulder 73 when shoulders 87, 89 engage each other and running tool 25 is moved downward.

Figure 2:
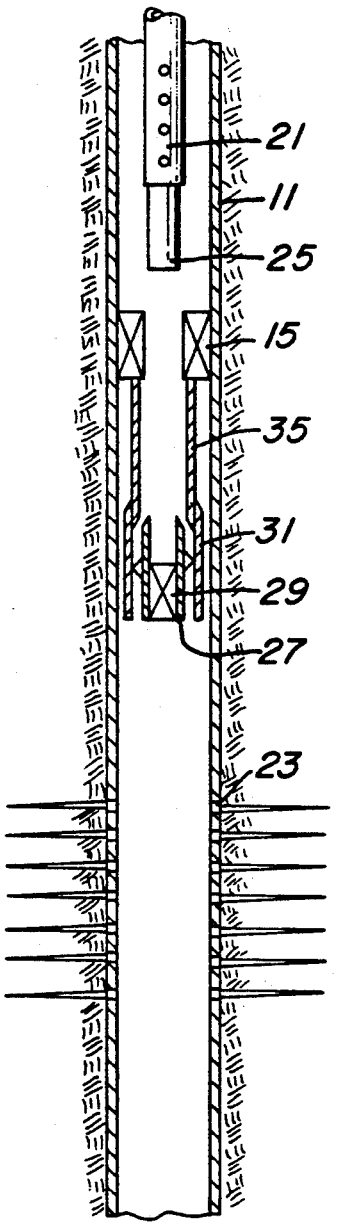
FIG. 2 is a schematic view of the apparatus of FIG. 1, showing the tubing and perforating gun being removed and with a latch assembly remaining latched into a seating profile.
Figure 3:
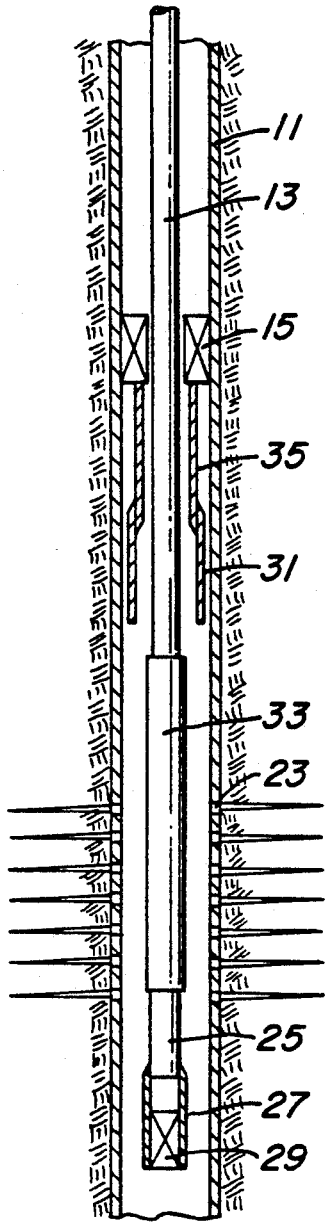
FIG. 3 is another view of the apparatus of FIG. 1, showing the tubing string lowered back into the well for a gravel pack operation, and showing the latch assembly located below the seat profile.

In operation, referring to FIGS. 1-3, the assembly in FIG. 1 will be lowered in unison. The casing 11 will be filled with a completion fluid. The operator will set packer 15 mechanically or hydraulically in a conventional manner. The operator will move the tubing 13 to release a seal sub (not shown) in packer 15 to provide an annular clearance between the bore of packer 15 and the tubing 13.

Then the operator will pump a lighter fluid down the tubing 13 to fill the tubing 13 only with a lighter fluid. The completion fluid previously contained in tubing 13 flows out circulation sub 17, up the annular clearance in the bore of packer 15 and into the casing 11 above packer 15. The amount of lighter fluid is selected so that it will not flow out of the circulation sub 17. Once the tubing 13 and the casing 11 are loaded with a liquid, the operator will move the tubing 13 again to close the annular clearance in the bore of packer 15. The operator will then fire the perforating gun 21. This is handled by dropping a bar or applying hydraulic pressure to the tubing 13 to rupture a disk.

After perforating, the operator then picks up the string of tubing 13, as illustrated in FIG. 2. The outer diameter of the latch assembly 27 is greater than the inner diameter of the seat profile 31, preventing the latch assembly 27 from passing above packer 15. The latch assembly 27 engages the seat profile 31 to retain the latch assembly 27 in place as shown in FIG. 2. The running tool 25 releases from the latch assembly 27 and is retrieved to the surface along with perforating gun 21. Plug 29 will block the flow of fluid in casing 11 down through the bore of packer 15 into the perforations 23.

Unless the operator wishes to utilize a gravel pack tool 33 (FIG. 3), he will normally remove the perforating gun 21 and re-enter the well with a production string of tubing 13. A running tool (not shown) on the lower end of tubing 13 will re-engage the packer 15 above latch assembly 27. The operator then lowers a conventional retrieval tool (not shown) on wireline for engaging plug 29. Normally the retrieval tool will manipulate the plug 29 initially to equalize pressure above packer 15 with that below. Then, the retrieval tool will retrieve the plug 29. The formation will be produced through the bore of the latch assembly 27, bore of packer 15, and up the tubing 13. The latch assembly 27 will remain in place.

Before production, the operator may wish to perform a gravel pack operation with a gravel pack tool 33 as shown in FIG. 3. If so, the plug 29 would not be of a type that would be retrieved. After removing the perforating gun 21, the running tool 25 will be secured to the lower end of the gravel pack tool 33. The operator re-engages the running tool 25 with the latch assembly 27. The operator continues downward movement to release the latch assembly 27 from the seat profile 31. The operator will move the gravel pack tool 33 to a desired position as shown in FIG. 3 and perform conventional gravel pack operations.

Describing the operation of the latch assembly 27 in more detail, in the initial position when as in FIG. 1, the latch assembly 27 will appear as in FIGS. 4*a*, *b* and *c*. After firing perforating gun 21, the operator picks up tubing 13. Eventually, the housing shoulder 53 (FIG. 4*c*) will engage the seat profile shoulder 41. This stops upward movement of housing 47. The operator continues to pull upward. Shear screws 67 (FIG. 4*c*) will shear. Seal 51 will seal the outer diameter of housing 47 to the bore of seat profile 31.

Continued upward movement causes mandrel 45 to move upward relative to housing 47. This upward movement is due to the engagement of collet dogs 71 located on shoulder 73 (FIG. 4*a*). Mandrel 45 will slide upward relative to actuating ring 61 until stop ring 63 contacts actuating ring 61. At that point, actuating ring 61 will move with mandrel 45 and push the collet dogs 59 into engagement with shoulder 39. This prevents downward movement of housing 47.

During the upward movement of mandrel 45 relative to housing 47, the mandrel deflecting shoulders 85 will deflect past the housing deflecting shoulder 83 to the position shown in FIG. 5*b*. During upward movement of mandrel 45, the shoulders 77, 79 will cause the running tool 25 to continue to pull mandrel 45 a short distance upward after collet dogs 71 enter recess 75. The shoulders 77, 79 release from each other as soon as the lower mandrel shoulder 85 clears the housing shoulder 83. When mandrel 45 is in its upper position, collet dogs 71 locate in housing recess 75 as shown in FIG. 5*a*. As collet dogs 71 no longer engage shoulder 73, running tool 25 will then move upward out of the mandrel 45 and be retrieved to the surface. Mandrel 45 and housing 47 will remain secured to seat profile 31. Plug 29 and seal 51 will block the downward flow of well fluid located in casing 11 (FIG. 1) above packer 15.

Figure 5C:
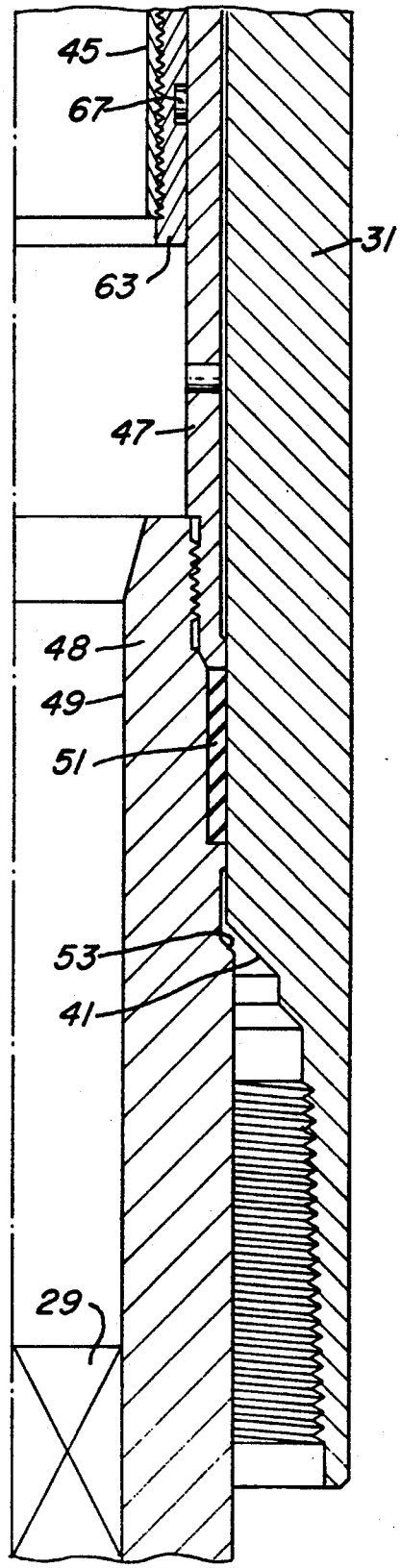

FIGS. 5*a*, 5*b*, and 5*c* show the running tool 25 being retrieved. Hydrostatic differential has pushed the housing 47 downward slightly, with the seat engaging collet lower end 59 contacting seat shoulder 39 (FIG. 5*b*). Housing shoulder 53 (FIG. 5*c*) will be spaced slightly below seat shoulder 41.

The positions of the components during re-entry is not shown in the drawings, but is readily understood by the following description. Upon re-entry with a gravel pack tool 33 (FIG. 3), running tool 25 will stab into mandrel 45. Running tool shoulder 87 (FIG. 4*a*) will contact mandrel shoulder 89, pushing mandrel 45 downward. The smaller bore 50 immediately below recess 75 will push the collet dogs 71 into the recess above shoulder 73, reconnecting the running tool 25 to the mandrel 45. The portion of bore 50 below recess 75 prevents the collet dogs 71 from moving out of engagement with shoulder 73.

Note that when the mandrel 45 is in the upper position as shown in FIG. 5*b*, the mandrel shoulder 65 will be located above the actuating ring 61. Consequently, during the initial downward movement of the running tool 25 and the mandrel 45, the actuating ring 61 will remain in place. Actuating ring 61 will keep the collet dogs 59 in the engaged position with shoulder 39 until the mandrel deflecting shoulders 85 (FIG. 4*b*) are almost past housing deflecting shoulders 83 and until the collet dogs 71 (FIG. 4*a*) have fully re-engaged the running tool 25.

Eventually, the downward movement will cause the shoulder 65 to contact the actuating ring 61 and to push it to the position shown in FIG. 4*b*. In that position, the collet dogs 59 are free to spring inward. This releases the housing 47 from the seat profile 31. Continued downward movement will position the latch assembly 27 below the seat profile 31, as shown in FIG. 3. At that point, the operator will conduct gravel packing operations with gravel packing tool 33.

The invention has significant advantages. The plug and latching assembly effectively close the bore of the packer when the tubing has been retrieved to retrieve the perforating gun. This prevents extensive fluid loss from the casing through the packer. The latch assembly is readily re-engaged by the tubing string upon re-entry for gravel packing operations.

While the invention has been shown in only one of its forms, it should be apparent to those skilled in the art that it is not so limited, but is susceptible to various changes without departing from the scope of the invention.

We claim:

1. In a well servicing assembly, having a packer releasably carried by a string of tubing for setting in casing, an apparatus for preventing fluid in the casing from flowing down through the packer and into an earth formation, comprising:

a seat profile mounted to the packer;

latch means carried on the string of tubing, for releasably latching into the seat profile when the string of tubing is pulled upward, and for releasing from the string of tubing once latched into the seat profile;

a plug carried by the latch means for blocking downward flow through the packer when the latch means is seated in the seat profile; and wherein the latch means selectively reconnects with a lower end of the string of tubing and is movable to a selected point below the seat profile when the string of tubing is lowered again into the well.

2. In a well servicing assembly, having a packer releasably carried by a string of tubing for setting in casing, an apparatus for preventing fluid in the casing from flowing down through the packer and into an earth formation, comprising:

a seat profile mounted to the packer;

latch means carried on the string of tubing, for releasably latching into the seat profile when the string of tubing is pulled upward, and for releasing from the string of tubing once latched into the seat profile;

a plug carried by the latch means for blocking downward flow through the packer when the latch means is seated in the seat profile; and wherein the latch means comprises:

a tubular housing;

a mandrel carried in the housing for sliding movement relative to the housing;

a running tool secured to a lower end of the string of tubing, the running tool having a lower end which extends into the mandrel;

a seat engaging member carried in the housing for movement between a released position in which the housing is movable relative to the seat profile, and an engaged position in engagement with the seat profile to secure the housing to the seat profile against movement;

actuating means for moving the seat engaging member to the engaged position in response to upward movement of the mandrel relative to the housing; and a running tool engaging member carried by the mandrel for movement between an engaged position in which the running tool is secured to the mandrel for moving the mandrel upward with the running tool relative to housing after the seat engaging member is in engagement with the seat profile, and a released position in which the mandrel is secured to the housing against movement and the running tool is free to move upward relative to the mandrel.

3. In a well servicing assembly, having a packer releasably carried by a string of tubing for setting in casing, an apparatus for preventing fluid in the casing from flowing down through the packer and into an earth formation, comprising:

a seat profile mounted to the packer;

a tubular housing dimensioned to engage the seat profile;

seal means on the housing for sealing the housing to the seat profile;

plug means carried in the housing for blocking downward flow through the housing and through the packer when the housing is in engagement with the seat profile;

running tool means carried by the string of tubing and engageable with the housing for pulling the tubular housing upward into the seat profile by upward movement with the string of tubing after perforation;

seat engaging means carried by the housing for releasably latching the housing into the seat profile when the running tool pulls the housing up into the seat profile to secure the housing to the seat profile against movement;

running tool engaging means for releasing engagement of the running tool means from the housing after the seat engaging means has latched the housing to the seat profile, to allow the running tool means to be retrieved and wherein the running tool engaging means also is for re-engaging the running tool means with the housing upon subsequent lowering of the running tool means on the string of tubing; and wherein the seat engaging means is also for releasing the housing from the seat profile upon re-engagement of the running tool means with the housing to allow the housing to be moved below the seat profile.

4. In a well servicing assembly, having a packer releasably carried by a string of tubing for setting in casing, an apparatus for preventing fluid in the casing from flowing down through the packer and into an earth formation, comprising:

a seat profile mounted to the packer;

a tubular housing dimensioned to engage the seat profile;

seal means on the housing for sealing the housing to the seat profile;

plug means carried in the housing for blocking downward flow through the housing and through the packer when the housing is in engagement with the seat profile;

running tool means carried by the string of tubing and engageable with the housing for pulling the tubular housing upward into the seat profile by upward movement with the string of tubing after perforation;

seat engaging means carried by the housing for releasably latching the housing into the seat profile when the running tool pulls the housing up into the seat profile to secure the housing to the seat profile against movement;

running tool engaging means for releasing engagement of the running tool means from the housing after the seat engaging means has latched the housing to the seat profile, to allow the running tool means to be retrieved and wherein the running tool engaging means also is for re-engaging the running tool means with the housing upon subsequent lowering of the running tool means on the string of tubing; and wherein the housing has a bore, and wherein the plug means releasably locates within the bore.

5. In a well servicing assembly, having a packer releasably carried by a string of tubing for setting in casing, an apparatus for preventing fluid in the casing from flowing down through the packer and into an earth formation, comprising:

a seat profile mounted to the packer;

a tubular housing dimensioned to engage the seat profile;

seal means on the housing for sealing the housing to the seat profile;

plug means carried in the housing for blocking downward flow through the housing and through the packer when the housing is in engagement with the seat profile;

running tool means carried by the string of tubing and engageable with the housing for pulling the tubular housing upward into the seat profile by upward movement with the string of tubing after perforation;

seat engaging means carried by the housing for releasably latching the housing into the seat profile when the running tool pulls the housing up into the seat profile to secure the housing to the seat profile against movement;

running tool engaging means for releasing engagement of the running tool means from the housing after the seat engaging means has latched the housing to the seat profile, to allow the running tool means to be retrieved and wherein the running tool engaging means also is for re-engaging the running tool means with the housing upon subsequent lowering of the running tool means on the string of tubing; and wherein the seat profile has a downward facing shoulder of smaller inner diameter than an outer diameter of the housing to prevent the housing from moving above the seat profile.

6. In a well servicing assembly, having a packer releasably carried by a string of tubing for setting in casing, an apparatus for preventing fluid in the casing from flowing down through the packer and into an earth formation, comprising:

a seat profile mounted to the packer;

a tubular housing dimensioned to engage the seat profile;

seal means on the housing for sealing the housing to the seat profile;

plug means carried in the housing for blocking downward flow through the housing and through the packer when the housing is in engagement with the seat profile;

running tool means carried by the string of tubing and engageable with the housing for pulling the tubular housing upward into the seat profile by upward movement with the string of tubing after perforation;

seat engaging means carried by the housing for releasably latching the housing into the seat profile when the running tool pulls the housing up into the seat profile to secure the housing to the seat profile against movement;

running tool engaging means for releasing engagement of the running tool means from the housing after the seat engaging means has latched the housing to the seat profile, to allow the running tool means to be retrieved and wherein the running tool engaging means also is for re-engaging the running tool means with the housing upon subsequent lowering of the running tool means on the string of tubing; and wherein the seat profile has a downward facing shoulder of smaller inner diameter than an outer diameter of the housing to prevent the housing from moving above the seat profile; and the seat profile has an upward facing shoulder that is engaged by the seat engaging means to prevent the housing from moving downward relative to the housing after the seat engaging means has latched the housing to the seat profile.

7. In a well servicing assembly, having a packer releasably carried by a string of tubing for setting in casing, an apparatus for preventing fluid in the casing from flowing down through the packer and into an earth formation, comprising:

a seat profile mounted to the packer;

a tubular housing dimensioned to engage the seat profile;

seal means on the housing for sealing the housing to the seat profile;

plug means carried in the housing for blocking downward flow through the housing and through the packer when the housing is in engagement with the seat profile;

running tool means carried by the string of tubing and engageable with the housing for pulling the tubular housing upward into the seat profile by upward movement with the string of tubing after perforation;

seat engaging means carried by the housing for releasably latching the housing into the seat profile when the running tool pulls the housing up into the seat profile to secure the housing to the seat profile against movement;

running tool engaging means for releasing engagement of the running tool means from the housing after the seat engaging means has latched the housing to the seat profile, to allow the running tool means to be retrieved and wherein the running tool engaging means also is for re-engaging the running tool means with the housing upon subsequent lowering of the running tool means on the string of tubing; and wherein the seat profile has a downward facing shoulder of smaller inner diameter than an outer diameter of the housing to prevent the housing from moving above the seat profile, and wherein the seat engaging means comprises:

a seat engaging member carried in the housing for movement between a released position in which the housing is movable relative to the seat profile, and an engaged position in engagement with the seat profile to secure the housing to the seat profile against movement; and actuating means for moving the seat engaging member to the engaged position in response to upward movement of the running tool means relative to the housing after the housing has contacted the downward facing shoulder of the seat profile.

8. In a well servicing assembly, having a packer releasably carried by a string of tubing for setting in casing, an apparatus for preventing fluid in the casing from flowing down through the packer and into an earth formation, comprising:

a seat profile mounted to the packer;

a tubular housing dimensioned to engage the seat profile;

seal means on the housing for sealing the housing to the seat profile;

plug means carried in the housing for blocking downward flow through the housing and through the packer when the housing is in engagement with the seat profile;

running tool means carried by the string of tubing and engageable with the housing for pulling the tubular housing upward into the seat profile by upward movement with the string of tubing after perforation;

seat engaging means carried by the housing for releasably latching the housing into the seat profile when the running tool pulls the housing up into the seat profile to secure the housing to the seat profile against movement;

running tool engaging means for releasing engagement of the running tool means from the housing after the seat engaging means has latched the housing to the seat profile, to allow the running tool means to be retrieved and wherein the running tool engaging means also is for re-engaging the running tool means with the housing upon subsequent lowering of the running tool means on the string of tubing; and wherein the running tool engaging means comprises:

a mandrel carried in the housing; and a running tool engaging member carried by the mandrel for movement between an engaged position in which the running tool means is secured to the mandrel for moving the mandrel upward with the running tool means relative to housing after the housing has latched to the seat profile, and a released position in which the mandrel is secured to the housing against movement and the running tool means is free to move upward relative to the mandrel.

9. In a well servicing assembly, having a packer releasably carried by a string of tubing for setting in casing, an apparatus for preventing fluid in the casing from flowing down through the packer and into an earth formation, comprising:

a seat profile mounted to the packer;

a tubular housing dimensioned to engage the seat profile;

seal means on the housing for sealing the housing to the seat profile;

plug means carried in the housing for blocking downward flow through the housing and through the packer when the housing is in engagement with the seat profile;

running tool means carried by the string of tubing and engageable with the housing for pulling the tubular housing upward into the seat profile by upward movement with the string of tubing after perforation;

seat engaging means carried by the housing for releasably latching the housing into the seat profile when the running tool pulls the housing up into the seat profile to secure the housing to the seat profile against movement;

running tool engaging means for releasing engagement of the running tool means from the housing after the seat engaging means has latched the housing to the seat profile, to allow the running tool means to be retrieved and wherein the running tool engaging means also is for re-engaging the running tool means with the housing upon subsequent lowering of the running tool means on the string of tubing; and wherein the seat profile has a downward facing shoulder of smaller inner diameter than an outer diameter of the housing to prevent the housing from moving above the seat profile, and wherein the seat engaging means comprises:

a seat engaging member carried in the housing for movement between a released position in which the housing is movable relative to the seat profile, and an engaged position in engagement with the seat profile to secure the housing to the seat profile against movement; and wherein the running tool engaging means comprises:

a mandrel carried in the housing, the mandrel being movable with the running tool means for moving the seat engaging member to the engaged position in response to upward movement of the running tool means and mandrel relative to the housing after the housing has contacted the downward facing shoulder of the seat profile; and a running tool engaging member carried by the mandrel for movement between an engaged position in which the running tool means is secured to the mandrel for moving the mandrel upward with the running tool means relative to housing after the housing has latched to the seat profile, and a released position in which the mandrel is secured to the housing against movement and the running tool means is free to move upward relative to the mandrel.

10. In a well completion assembly, having a packer releasably carried by a string of tubing for setting in casing, a perforating gun carried on the string of tubing below the packer for perforating the casing and an earth formation and subsequent retrieval through the packer to the surface, an apparatus for preventing fluid in the casing from flowing down through the packer and into the formation after the perforating gun is retrieved, comprising:

a running tool carried by the string of tubing below the perforating gun for movement with the string of tubing;

a tubular housing having an outer diameter and carried by the running tool;

a mandrel carried in the housing for vertical sliding movement relative to the housing between a lower and an upper position in response to movement of the running tool;

a running tool engaging member carried by the mandrel, having an inner engaged position in which the running tool is secured to the mandrel;

retaining means for preventing movement of the mandrel relative to the housing from the lower position to the upper position until a selected upward force on the mandrel has been applied;

a seat profile mounted to the packer, the seat profile having a downward facing shoulder of smaller inner diameter than the outer diameter of the housing to prevent the housing from moving above the seat profile when pulled upward by the running tool after perforation, the seat profile having an upward facing shoulder;

a seat engaging member carried in the housing for movement between an inner released position in which the housing is movable relative to the seat profile, and an outer engaged position in engagement with the upward facing shoulder of the seat profile to secure the housing to the seat profile against downward movement;

the mandrel moving the seat engaging member to the engaged position in response to upward movement of the mandrel relative to the housing after the housing has contacted the downward facing shoulder of the seat profile;

a plug carried by the housing for blocking downward flow through the housing and through the packer when the housing is in engagement with the seat profile;

the running tool engaging member being movable to an outer released position when the mandrel is in the upper position and in which the mandrel is secured to the housing against movement and the running tool is free to move upward relative to the mandrel;

the running tool engaging member re-engaging the running tool with the mandrel upon subsequent lowering of the running tool on the string of tubing without the perforating gun; and the seat engaging member releasing the housing from the seat profile upon re-engagement of the running tool with the mandrel to allow the housing to be moved below the seat profile.

11. The apparatus according to claim 10 further comprising an actuating sleeve carried by the mandrel below the seat engaging member for limited movement with the mandrel; and wherein the seat engaging member is a seat engaging collet having an end biased toward the inner released position and movable to the outer engaged position when contacted by the actuating sleeve.

12. The apparatus according to claim 10 further comprising an actuating sleeve carried by the mandrel below the seat engaging member for limited movement with the mandrel; wherein the seat engaging member is a seat engaging collet having an end biased toward the inner released position and movable to the outer engaged position when contacted by the actuating sleeve; and wherein the mandrel slides downward relative to the actuating sleeve a selected distance upon re-engagement of the running tool prior to moving with the mandrel, to allow the end of the seat engaging collet to spring back to the inner released position, the selected distance being sufficient to assure that the running tool engaging member will be in the engaged position before the seat engaging collet is in the released position.

13. The apparatus according to claim 10 wherein:

the running tool has an upward facing shoulder;

the housing has an internal recess located above the seat engaging member; and the running tool engaging member is a running tool collet mounted to the mandrel, having an end biased toward the outer released position and held in the inner engaged position by contact of the housing until the mandrel moves upward sufficiently for the end of the running tool collet to spring outward into the recess of the housing.

14. The apparatus according to claim 10 further comprising an actuating sleeve carried by the mandrel below the seat engaging member for limited movement with the mandrel; wherein the seat engaging member is a seat engaging collet having an end biased toward the inner released position and movable to the outer engaged position when contacted by the actuating sleeve;

the running tool has an upward facing shoulder;

the housing has an internal recess located above the seat engaging member;

the running tool engaging member is a running tool collet mounted to the mandrel, having an end biased toward the outer released position and held in the inner engaged position by contact of the housing until the mandrel moves upward sufficient for the end of the running tool collet to spring outward into the recess of the housing, the distance from the lower position to the upper position of the mandrel being selected to assure that the seat engaging collet will move to the outer engaged position before the running tool collet moves to the inner released position; and the mandrel slides downward relative to the actuating sleeve a selected distance upon re-engagement of the running tool prior to moving with the mandrel to allow the end of the seat engaging collet to spring back to the inner released position, the selected distance being sufficient to assure that the running tool collet will be in the engaged position before the seat engaging collet is in the released position.

15. The apparatus according to claim 10 further comprising:

an upward facing running tool shoulder on the running tool;

a downward facing mandrel shoulder in the interior of the mandrel and spaced above the running tool shoulder when the running tool is engaged with the mandrel, the inner periphery of the mandrel shoulder being spaced a greater radial distance outward from a longitudinal axis of the mandrel than the radial distance of the outer periphery of the running tool shoulder when the mandrel is in the upper position to allow the running tool to be pulled upward from the mandrel; and deflecting means in the interior of the housing for deflecting the mandrel shoulder radially inward into an interfering position with the running tool shoulder when the mandrel is being moved from the lower position to the upper position, to prevent the housing from dropping from the seat profile in the event the running tool engaging means accidentally released from the mandrel prior to the seat engaging means engaging the seat profile.

16. In a well servicing assembly, having a packer releasably carried by a string of tubing for setting in casing, an apparatus for preventing fluid in the casing from flowing down through the packer and into an earth formation, comprising:

a running tool carried by the string of tubing for movement with the string of tubing;

a tubular housing having an outer diameter and carried by the running tool;

a mandrel carried in the housing for vertical sliding movement relative to the housing between a lower and an upper position in response to movement of the running tool;

a running tool collet carried by the mandrel having an end which moves radially between an inner engaged position in which the running tool is secured to the mandrel and an outer released position in which the running tool is released from the mandrel and the mandrel is in the upper position;

retaining means for preventing movement of the mandrel relative to the housing from the lower position to the upper position until a selected upward force on the mandrel has been applied;

a seat profile mounted to the packer, the seat profile having a downward facing shoulder of smaller inner diameter than the outer diameter of the housing to prevent the housing from moving above the seat profile when pulled upward by the running tool, the seat profile having an upward facing shoulder;

a seat engaging collet carried by the housing, having an end biased toward an inner released position and movable to an outer engaged position in engagement with the upward facing shoulder of the seat profile, the seat engaging collet being biased toward the inner released position;

actuator means on the mandrel for moving the seat engaging collet to the engaged position in response to upward movement of the mandrel relative to the housing after the housing has contacted the downward facing shoulder of the seat profile and prior to the running tool collet moving to outer released position;

a plug carried by the housing for blocking downward flow through the housing and through the packer when the housing is in engagement with the seat profile;

the running tool collet re-engaging the running tool with the mandrel upon subsequent lowering of the running tool on the string of tubing; and the seat engaging collet releasing the housing from the seat profile after re-engagement of the running tool with the running tool collet to allow the housing to be moved below the seat profile, the actuator means preventing the seat engaging collet from releasing the housing until the running tool collet has re-engaged the running tool.

17. The apparatus according to claim 16 further comprising:

an external downward facing safety shoulder on the running tool;

an internal upward facing safety shoulder in the mandrel; and deflecting means for deflecting the safety shoulder in the mandrel radially inward during upward and downward movement of the mandrel, causing the safety shoulders to engage each other, and to allow the safety shoulders to release from each other when the mandrel is in the upper position.

18. The apparatus according to claim 17 wherein the deflecting means comprises:

a housing deflecting shoulder protruding radially inward from the interior of the housing above the seat engaging collet;

a resilient section formed in the mandrel, the mandrel safety shoulder being located in the resilient section;

a mandrel deflecting shoulder protruding radially outward from the mandrel in the resilient section and located below the housing deflecting shoulder when the mandrel is in the lower position and above the housing deflecting shoulder when the mandrel is in the upper position, the housing deflecting shoulder having an inner diameter that is less than the outer diameter of the mandrel deflecting shoulder when the resilient section is in an undeflected condition, so that when the mandrel is pulled upward relative to the housing, the mandrel shoulder engages the housing shoulder to deflect the deflecting section.

19. In a method of servicing a well comprising the steps of lowering a packer on a string of tubing into casing and setting the packer, mounting a perforating gun in the string of tubing below the packer for perforating the casing and an earth formation and subsequent retrieval through the packer to the surface, a method for preventing fluid in the casing from flowing down through the packer and into the perforated earth formation after perforating with the perforating gun, comprising:

mounting a seat profile to the packer;

mounting a latch assembly to the string of tubing below the perforating gun;

mounting a plug to the latch assembly;

pulling upward on the string of tubing and latching the latch assembly into the seat profile; then releasing the latch assembly from the string of tubing once latched into the seat profile;

blocking downward flow through the packer with the plug, the method further comprising:

lowering the string of tubing back into the well and re-engaging the latch assembly with the string of tubing; then releasing the latch assembly from the seat profile and lowering the string of tubing further to position the latch assembly below the seat profile.

20. A method of completing a well comprising:

mounting a seat profile to a packer;

mounting a perforating gun to a string of tubing and positioning the perforating gun below the packer;

mounting a latch assembly to the string of tubing below the perforating gun;

mounting a plug to the latch assembly;

lowering the perforating gun and the packer on the string of tubing into casing;

setting the packer; then firing the perforating gun to perforate the casing and an earth formation; then pulling upward on the string of tubing and latching the latch assembly into the seat profile; then releasing the latch assembly from the string of tubing once latched into the seat profile, and blocking downward flow through the packer with the plug; then retrieving the perforating gun to the surface with the string of tubing; the method further comprising:

disconnecting the perforating gun from the string of tubing at the surface after firing; then lowering the string of tubing back into the well and re-engaging the latch assembly with the string of tubing; then releasing the latch assembly from the seat profile and lowering the string of tubing further to position the latch assembly below the seat profile.

* * * * *